United States Patent [19]
Schmieder et al.
[11] 4,056,482
[45] Nov. 1, 1977

[54] METHOD FOR PREPARING AQUEOUS, RADIOACTIVE WASTE SOLUTIONS FROM NUCLEAR PLANTS FOR SOLIDIFICATION

[75] Inventors: Helmut Schmieder, Karlsruhe; Reinhard Kroebel, Leopoldshafen, both of Germany

[73] Assignee: Gesellschaft fur Kernforschung m.b.H., Karlsruhe, Germany

[21] Appl. No.: 624,108

[22] Filed: Oct. 20, 1975

[30] Foreign Application Priority Data

Oct. 18, 1974 Germany ..... 2449588

[51] Int. Cl.[2] ..... G21F 9/04
[52] U.S. Cl. ..... 252/301.1 W; 204/149
[58] Field of Search ..... 252/301.1 W; 204/149; 210/DIG. 28

[56] References Cited

U.S. PATENT DOCUMENTS

| | | | |
|---|---|---|---|
| 2,854,315 | 9/1958 | Altes et al. | 423/11 |
| 3,856,574 | 12/1974 | Amagi et al. | 252/502 |

OTHER PUBLICATIONS

Barney, D. L., "Investigation of Electrolysis as a Method for the Treatment of Radioactive Nitric Acid Wastes," Report No. KAPL-1263, 1-4-55.
Stoller et al., Eds., Reactor Handbook vol. II, Fuel Reprocessing Interscience Publishers, Inc. N. Y., 1961, pp. 152-155.
NSA vol. 12, No. 7215, "Electrolytic Recycle Method for the Treatment of Radioactive Nitric Waste".
NSA vol. 13, No. 8219, "Proposal for Installation of Equipment for Treatment of ORNL High Level Waste".

*Primary Examiner*—Benjamin R. Padgett
*Assistant Examiner*—Deborah L. Kyle
*Attorney, Agent, or Firm*—Spencer & Kaye

[57] ABSTRACT

A method is provided for preparing aqueous, radioactive waste solutions, from reprocessing plants for spent nuclear fuel and/or breeder materials and other nuclear plants, for noncontaminating solidification and/or removal of such solutions. The total quantity of the various inorganic and organic substances in the waste solution is reduced by the destruction of nitric acid, nitrates and nitrites and the formation of a waste gas mixture which is practically free of higher nitrous oxides. To bring this about, the radioactive waste solutions are subjected to an electrolysis current at such current densities at the anode and at the cathode that in one process step the substances of the group hydrazine, hydroxylamine, oxalic acid, oxalates, tartaric acid and tartrates are oxidized at the anode and the substances of the group nitric acid, nitrates and nitrites are reduced at the cathode.

8 Claims, No Drawings

METHOD FOR PREPARING AQUEOUS, RADIOACTIVE WASTE SOLUTIONS FROM NUCLEAR PLANTS FOR SOLIDIFICATION

BACKGROUND OF THE INVENTION

The present invention relates to a process for preparing aqueous, radioactive waste solutions, from reprocessing plants for spent nuclear fuel and/or breeder materials and other nuclear plants, for noncontaminating solidification and/or removal of such solutions, and more particularly relates to a process in which the total quantity of the various inorganic and organic substances contained in the aqueous radioactive waste solutions are reduced by destroying nitric acid, nitrates and nitrites and forming a waste gas mixture which is practically free of higher nitrous oxides.

Radioactive waste, no matter what kind, must be permanently stored or removed, respectively, in a manner such that there practically can be no possibility of discharge of dangerous radionuclides into the biocycle, even under accidental, or unfavorable conditions, for example, at the final storage location.

In addition to providing a safe final storage location, additional measures must be taken to insure safe handling of the aqueous radioactive solutions before they reach a final storage location and to further insure that the radioactive wastes are safe at the final storage location. For this reason, dangerous radionuclides, before they are transported and/or permanently stored or removed, must be brought into a form which substantially prevents the undesirable release or distribution of these radionuclides into the biocycle before they have lost their dangerous properties or have been converted to stable, harmless nuclides. In order to bring radionuclides into such a form, solidification processes are used, such as, for example, fixing them in glass, ceramic, or basalt-like masses, bitumen, cement rock, and the like. The products from such processes are shaped bodies, with or without protective sheathings, or masses which are introduced into drums or similar containers during the process and solidify therein. The volumes of the shaped bodies and of the solidified masses should be kept as low as possible.

Aqueous, radioactive waste solutions from nuclear plants must thus be prepared for solidification. For this purpose, particularly if they are highly radioactive, the aqueous radioactive waste solutions are initially concentrated in an evaporator and the concentrate, which is 4 to 6 molar nitric acid, is intermediately stored for several years in expensive, cooled and ventilated container systems of stainless steel until part of the radioactivity has decayed. In order to reduce the rate of corrosion of the stainless steel, it is the custom to either partially neutralize the nitric acid or to add reduction agents such as sugar, formaldehyde or formic acid, to reduce the nitric acid concentration in the concentrate to 1 to 2 mols/liter. This procedure is expensive and the use of reduction agents involves a certain risk because such reactions sometimes may take place at an uncontrollable speed.

In the case where formaldehyde solutions are used, the reaction is difficult to control, foam forms and the formaldehyde may polymerize. If sugar solutions are used, foaming is also a problem and an excess of sugar may lead to explosions when the dry residue is heated.

Reactions of nitric acid with formaldehyde and with formic acid, in theory and in practice, are described by T. V. Healy in the Journal of Applied Chemistry, Vol. 8 (September, 1958), on pages 553–561. In his practical experiments, the reduction agent was always introduced into the nitric acid. This produced waste gas mixtures which contained considerable proportions of higher nitrous oxides. The composition of the waste gas mixtures lay in the range of the two compositions described below. The first composition contained, in volume percent, 4% $NO_2$, 36% NO, and 60% $CO_2$.

The second composition contained, in volume percent,

82% $NO_2$, 0% NO, and 16% $CO_2$.

In another process for removing nitric acid and/or nitrate and nitrite ions from aqueous waste solutions, as described in U.S. Pat. No. 3,673,086 to Drobnik, the originally present free nitric acid, all nitrite ions, and all of the nitrate ions belonging to the more than two-valent cations and to all heavy metal cations are completely destroyed upon the controlled introduction of the waste solution into nitric acid or a nitric acid solution. A waste gas mixture is obtained which is independent of the acid concentration of the starting solution. The gas mixture is practically free of higher nitrous oxides and has the following composition, by volume:

78% $CO_2$, 16% $N_2O$, 5% NO, and 1% $N_2$.

Highly radioactive, aqueous waste solutions (HAW) are produced in the first extraction cycle of the presently employed reprocessing procedures for spent nuclear fuel and/or breeder materials according to the Purex type (plutonium reduction and extraction). These highly radioactive waste solutions are introduced, after intermediate storage, as a liquid, or by means of a Thermit process, to solidify in glass, ceramic or basalt-like masses. This, however, makes it absolutely necessary that the waste solutions be previously subjected to a substantial denitration with subsequent calcination.

In order to reduce the long-term damage potential during permanent storage of solidified HAW's, the necessity of separating the long-lived transuraniums from the HAW's before solidification is presently being discussed with increasing fervor. Proposed processes with this in mind always include denitration of the liquid HAW to a pH between 2 and 5, and selective extraction of the actinides with strong complex formers such as, for example, di-(2-ethylhexyl)-phosphorus acid (HDEHP) or others.

The solutions obtained in the subsequent extraction cycles and at other points in the Purex process contain smaller amounts of fission products and residual fission products, and are considered as medium active wastes (MAW). These medium active waste solutions must also be separated from free nitric acid before they are solidified by, for example, bituminization or embedding in cement. This is presently frequently done by neutralization with sodium liquor or also by the addition of reduction agents.

Difficulties often arise during denitration with chemical reduction agents, inter alia, during the exact setting of a pH within the above-mentioned narrow range.

The cathodic reduction of nitric acid to nitrous acid is known and the reaction sequence has been discussed. See, for example, G. Schmid, Magazine for Electrochemistry, volume 63 (1959), issue 9/10, pages 1183–1188). The lowest oxidation stage of the reduction products mentioned therein, however, is nitrous oxide (N0).

In USAEC Report No. KAPL-1263, "Investigation of Electrolysis as a Method for the Treatment of Radioactive Nitric Acid Wastes," January 4, 1955 (Knolls Atomic Power Laboratory), D. L. Barney reports, however, that the following substances have been identified as products of electrolytic reduction of nitric acid under various conditions:

$NO_2$, $HNO_2$, $N_2O$, NO, $N_2$, $NH_2OH$ and $NH_4^+$.

The report states that the predominant product is nitrogen dioxide. $NO_2$ and NO are desirable because of their easy recombination with anodically produced oxygen and with water to form $HNO_3$, while $N_2O$, $N_2$ and the $NH_4^+$ ions are undesirable. It is further stated in the report that during the electrolytic reduction of $HNO_3$, hydrogen is formed first, followed by a period of nitric acid reduction in which practically no $H_2$ is produced until the $HNO_3$ concentration has been reduced to a certain critical value. Below this critical $HNO_3$ concentration, $H_2$ is again the predominant reduction product. D. L. Barney used platinum electrodes and, under various conditions, found values for the critical $HNO_3$ concentration which never fell below the value of 3 mols of $HNO_3$ per liter. At a current density of 840 mA/cm$^2$ and a potential of 4.1 V, the critical concentration was about 5.9 mols of $HNO_3$ per liter. At a current density of 280 mA/cm$^2$ and a potential of 1.9 V, the critical concentration was about 3.8 mols of $HNO_3$ per liter.

In the Barney report, $N_2O$ was produced below the critical concentration, but before $H_2$ constituted the sole electrolysis product. As shown in the graphic illustrations in the Barney report regarding the composition of the waste gas in dependence on the $HNO_3$ concentration, no $N_2O$ is produced below a concentration of 3 mols of $HNO_3$ per liter. Only $H_2$ is produced below this concentration. Barney further reports of tests with an addition of 0.01 M $Cu(NO_3)_2$ in which, in spite of an improved $HNO_3$ reduction, residual concentrations of $HNO_3$ remained. On the other hand, as evidenced by the composition of the waste gases, the formation of $NO_2$ could not be completely avoided. Upon comparing the electrolytic reduction with the acid distillation, Barney came to the conclusion that acid distillation was more attractive.

SUMMARY OF THE INVENTION

It is a primary object of the present invention to provide a process for preparing aqueous, radioactive waste solutions for noncontaminating solidification in glass, ceramic or basalt-like masses, and the like, as well as in bitumen or cement blocks and the like.

Another object of the present invention is to provide such a process which avoids the drawbacks of the prior art methods and drastically reduces the salt content of the waste solutions and of the concentrates.

A further object of the present invention is to provide a process which facilitates and improves possible selective extraction of actinides from the waste solutions before solidification and assures harmless procedures during preparation as well as during solidification.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a method for preparing aqueous radioactive waste solutions for noncontaminating solidification and/or removal of such solutions. In the method of the present invention, the total quantity of the various inorganic and organic substances is reduced by the destruction of nitric acid, nitrates and nitrites and formation of a waste gas mixture which is practically free of higher nitrous oxides. In accordance with the present invention, the radioactive waste solutions are subjected to an electrolysis current at such current densities at the anode and at the cathode that, in one process step, the substances of the group hydrazine, hydroxylamine, oxalic acid, oxalates, tartaric acid and tartrates are oxidized at the anode and the substances of the group nitric acid, nitrates and nitrites are reduced at the cathode.

The process of the present invention produces gaseous oxidation and reduction products such as nitrogen, oxygen, and carbon dioxide, for example. In the process of the present invention, the above-mentioned substances hydrazine, hydroxylamine, oxalic acid, oxalates, tartaric acid and tartrates are completely destroyed in contradistinction to prior art processes.

It is to be understood that both the foregoing general description and the following detailed description are exemplary, but are not restrictive of the invention.

DETAILED DESCRIPTION OF THE INVENTION

In the practice of the present invention, aqueous radioactive waste solutions are subjected to an electrolysis current in an electrolysis cell. The aqueous waste solutions that can be treated by the method of the present invention generally can be those which are generated during the reprocessing of spent nuclear fuel or breeder material and include the highly active waste solutions and medium active waste solutions. For example, medium active waste solutions containing nitric acid and hydrazine or hydroxylamine can be prepared with the process of the present invention for solidification in bitumen. In addition, medium active waste solutions containing these nitrogen compounds as well as organic acids as complex formers, such as oxalic acid or tartaric acid and/or solutions containing salts of these acids (oxalates and tartrates) can be prepared with the process of the present invention for fixing in bitumen or cement. The salt substances, which can be present in such waste solutions to be treated are for example fission product nitrates, nitrates of alkali metals, nitrates of alkaline earth metals, nitrites of alkali metals, fission product oxalates, fission product tartrates, oxalates and tartrates of alkali metals. The waste solutions to be treated are mixtures of waste solutions coming not only from various devices of a reprocessing plant, but also from various laboratories or other working places. Therefore such a waste solution can but, need not contain all the above named substances.

The aqueous waste solutions that are treated in the process of the present invention are placed in an electrolysis cell where they serve as the electrolyte for the cell.

The apparatus required for the electrolytic denitration is very simple and does not include diaphragms. For discontinuous operation, any conventional electrolysis cell structure can be employed in practice. In the experiments described in the Examples, which follow hereafter, the cell was made of glass. For practical use, it is also possible to use the cathode material itself as the structure material for the cell. For continuous operation in a flowthrough cell, trough-shaped, elongated cells are recommended which are provided at various points with extraction devices for the various fission product fractions. The continuation of the oxidation-reduction processes is advisably monitored by checking the electrical conductivity of the solution.

The anode material of the cell can be platinum or a platinized metal with passivation properties. The cathode material of the cell can be titanium or graphite. The preferred platinized metals are platinized tantalum and platinized titanium. In principle, other metals, such as, for example, platinized zirconium and the like, can also be used, but if the surface of such anodes is damaged, corrosion will be too strong and the anode soon will be useless.

When a graphite cathode is used, difficulties or delays, respectively, which may occur at the start of the reduction reaction can be overcome by the addition of small quantities of metal ions from the group of copper, lead and titanium as starting aids to the waste solution. Additives which result in a concentration between 10 mg/l and 50 mg/l in the waste solution are sufficient. Reduction at the cathode takes place at a current density of about 10 mA/cm$^2$ or more, and the surface ratio of the effective cathode surface to the effective anode surface lies in the range of about 0.1 to about 10. The ratio of the electrode surfaces can be varied over a much wider range, for example, the ratio can be less than 0.1 or more than 10. For practical use, however, surface ratios in the above-mentioned range of 0.1 to 10 are most appropriate. The upper limit of the current density at the cathode should be in accordance with economical considerations, for example about 100 mA/cm$^2$. The length of the treatment is not relevant, because the surface of the electrode is deciding for the rapidity with which the destroying reactions run and thus for the length of time.

The advantages of the process of the present invention are that no addition of neutralizing and/or reduction chemicals is required, thus reducing costs and apparatus involved as well as space requirements. Further, the waste gases contain practically no nitrous gases and the process is dependable and easily controllable.

A further advantage of the present invention is that it is possible to fractionate the fission products. In the experiments with fission products, it has been found that the noble metals, such as Ag, Pd, Ru and Rh, for example, in the still strongly acid solution are cathodically reduced to metal and precipitated while the remaining fission products remain in solution at these acid concentrations. Under certain circumstances, it will be possible in this way to indirectly shorten the intermediate storage periods for the waste solutions.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

This example illustrates the treatment of a simulated aqueous waste solution in an electrolysis cell in accordance with the teachings of the present invention. The waste solution serves as the electrolyte in the cell.

The cathode of the cell was made of titanium and had a surface area of about 80 cm$^2$. The current density at the cathode was a constant 50 mA/cm$^2$. The anode of the cell was made of platinum. The current density at the anode was about 250 mA/cm$^2$.

The volume of the simulated waste solution used in the cell was 90 ml. The waste solution had a 1.15 molar concentration of nitric acid and contained 0.1 mol per liter $N_2H_4$. Inactive noble metals Ag, Pd, Ru and Rh were added to the waste solution to simulate fission products. The waste solution was kept at a constant 20° C. At the beginning of the electrolysis process, precipitation started of the inactive noble metals Ag, Pd, Ru and Rh. The nitrite concentration at no time exceeded 100 mg/1. Gaseous reaction products which were found at the cathode were mainly hydrogen and nitrogen, as well as small quantities of NO and $N_2O$. Gaseous reaction products found at the anode were mainly nitrogen and oxygen, as well as small quantities of NO. At acid concentrations below 0.5 molar, $NH_3$ could be determined. After about 15 minutes, hydrazine could no longer be determined in the solution. After about 140 Ah/l, the hydrogen ion concentration had dropped from 1.15 mols per liter to 0.1 mol per liter. The drop in hydrogen ion concentration was linear.

EXAMPLE 2

This example illustrates the treatment of a simulated aqueous waste solution in an electrolysis cell. The same simulated waste solution was used as in Example 1, with the exception that 0.2 mol of $NaNO_3$ per liter was added to the simulated waste solution.

The cathode of the cell was made of titanium and had a surface area of about 40 cm$^2$. The current density at the cathode was a constant 100 mA/cm$^2$. The anode of the cell was made of platinum. The current density at the anode was about 250 mA/cm$^2$.

The starting volume of the waste solution was 90 ml. The course of the reaction was the same as in Example 1. During the reaction, the $H^+$ ion concentration decreased in a linear manner and dropped to zero. Due to the destruction of the nitrate ions, the reaction even lead to an increase in the concentration of free $OH^-$ ions to 0.25 mol per liter at 200 Ah/l.

EXAMPLE 3

In this example, an aqueous waste solution which contained 0.1 mol of uranium per liter, about 1.0 mol of $HNO_3$ per liter, and about 0.1 mol of $N_2H_5NO_3$ per liter, was treated in an electrolysis cell. The cathode was made of titanium and the anode of platinum.

Gas formation started at a current density at the cathode of about 5 mA/cm$^2$. The gas composition of the gas mixture produced at the cathode remained practically constant in the range of current densities between 5 and 33 mA/cm$^2$ and was 51 volume percent $H_2$, 48 volume percent $N_2$ (from $NO_2^- + N_2H_4$) and 1 volume percent NO.

Between 0.013 liter and 0.067 liter $H_2$/Ah were produced, and that is a current yield of between 3 and 16% in this current density range.

The composition of the gas mixture produced at the anode also remained constant over the above-mentioned current density range and was 95 volume percent $N_2$ (from $N_2H_4$), 4 volume percent $O_2$ (probably air that seeped in), and 1 volume percent NO.

About 0.2 liter of gas mixture per Ah were produced at the anode.

EXAMPLE 4

In this example, an aqueous waste solution which contained 0.96 mol $HNO_3$/l was treated in an electrolysis cell. No nitrite and no ammonium ions could be determined in the starting solution fed to the cell.

The cathode of the cell was made of graphite and had an area of about 78 $cm^2$. The current density at the cathode was about 50 mA/$cm^2$. The anode was made of platinum and had a surface area of about 10 $cm^2$.

After 4 hours, the pH of the waste solution had risen to pH 9. $NH_4^+$ ions had formed to a concentration of 0.4 mol/l. Nitric acid as well as nitrite ions could not be determined.

EXAMPLE 5

In this example, an aqueous waste solution, which at the start contained 1.3 mols $HNO_3$ per liter, was treated in an electrolysis cell. The cathode of the cell was made of graphite and had an area of about 78 $cm^2$. The current density at the cathode was 10 mA/$cm^2$. The anode was made of platinum and had an area of about 15 $cm^2$.

90 ml of the aqueous solution was added to the cell. No reaction took place at a current intensity of 800 mA. Only after the addition of 5 mg copper (II) ions into the aqueous solution did the reaction begin. The reaction was completed after 20 hours when no more $HNO_3$ could be found.

EXAMPLE 6

About 300 ml of a solution which was 1.5 molar $HNO_3$ and 0.1 molar $N_2H_4$ was circulated for several hours through an electrolysis cell. The cathode of the cell was made of titanium and had an area of about 20 $cm^2$. The anode of the cell was a platinum coated titanium drawn metal, and had an area of about 200 $cm^2$. The current intensity of the cell was 2A.

Upon completion of the treatment, neither $N_2H_4$, nor $HNO_2$, nor $HNO_3$ could be determined. $NH_4^+$ formation was noted.

EXAMPLE 7

This example illustrates the destruction of oxalic acid contained in an aqueous solution. The aqueous oxalic acid solution was added to an electrolysis cell containing a titanium cathode having a surface area of about 7.5 $cm^2$ and a platinum anode having a surface area of about 96 $cm^2$. The current intensity of the cell was 0.5A. The oxalic acid was completely destroyed and the current yield was between about 14% and about 22%. In a similar test, a platinum anode was used which had a surface area of about 85 $cm^2$ and substantially the same results were obtained.

EXAMPLE 8

This example illustrates the destruction of tartaric acid contained in an aqueous 1 M nitric acid solution. The concentration of the tartaric acid in the solution to be treated was 0,39 M/l. The electrolytic destruction of tartaric acid and nitric acid was carried out in a cell containing a titanium cathode and a platinum anode. The current density at the cathode was a constant 50 mA/$cm^2$ and that at the anode was 330 mA/$cm^2$. After the denitration up to the neutral point tartaric acid could not be determined.

It will be understood that the above description of the present invention is susceptible to various modifications, changes and adaptations and the same are intended to be comprehended within the meaning and range of equivalents of the appended claims.

What is claimed is:

1. A method for preparing aqueous, radioactive waste solutions, from reprocessing plants for spent nuclear fuel and/or breeder materials and other nuclear plants, for non-contaminating solidification and/or removal of such solutions, in which the total quantity of the various inorganic and organic substances is reduced by the destruction of nitric acid, nitrates and nitrites and formation of a waste gas mixture which is practically free of higher nitrous oxides, comprising subjecting the radioactive waste solution to an electrolysis current in an electrolysis cell that does not contain a diaphragm at such current densities at the anode and at the cathode that, in one process step, the substances selected from the group consisting of hydrazine, hydroxylamine, oxalic acid, oxalates, tartaric acid and tartrates are oxidized at the anode and the substances selected from the group consisting of nitric acid, nitrates and nitrites are reduced at the cathode.

2. The method as defined in claim 1 wherein the anode material employed is platinum or a platinized metal with passivation properties, and the cathode material is titanium or graphite.

3. The method as defined in claim 2 wherein the cathode is made of graphite, and small quantities of metal ions selected from the group consisting of copper, lead, and titanium are added to the aqueous waste solution to aid the start of the reduction reaction.

4. The method as defined in claim 1, wherein the reduction takes place at the cathode at a current density of about at least 10 mA/$cm^2$, and the surface ratio of the effective cathode surface to the effective anode surface is between about 0.1 and about 10.

5. A method for preparing aqueous, radioactive waste solutions, from reprocessing plants for spent nuclear fuel and/or breeder materials and other nuclear plants, for non-contaminating solidification and/or removal of such solutions, in which the total quantity of the various inorganic and organic substances is reduced by the destruction of nitric acid, nitrates and nitrites and formation of a waste gas mixture which is practically free of higher nitrous oxides, said solution containing at least one substance selected from the group consisting of nitric acid, nitrate, and nitrite, and at least one substance selected from the group consisting of hydrazine, hydroxylamine, oxalic acid, oxalates, tartaric acid and tartrates comprising subjecting the radioactive waste solution to an electrolysis current in an electrolysis cell that does not contain a diaphragm at such current densities at the anode and at the cathode that, in one process step, those substances selected from the group consisting of hydrazine, hydroxylamine, oxalic acid, oxalates, tartaric acid and tartrates that are present are oxidized at the anode and those substances selected from the group consisting of nitric acid, nitrates and nitrites that are present are reduced at the cathode.

6. The method as defined in claim 5 wherein the anode material employed is platinum or a platinized metal with passivation properties, and the cathode material is titanium or graphite.

7. The method as defined in claim 6 wherein the cathode is made of graphite, and small quantities of metal ions selected from the group consisting of copper, lead, and titanium are added to the aqueous waste solution to aid the start of the reduction reaction.

8. The method as defined in claim 5 wherein the reduction takes place at the cathode at a current density of about at least 10 mA/$cm^2$, and the surface ratio of the effective cathode surface to the effective anode surface is between about 0.1 and about 10.

* * * * *